United States Patent [19]

Yang

[11] Patent Number: 4,815,489

[45] Date of Patent: Mar. 28, 1989

[54] UMBRELLA INK MEANS HAVING RESILIENT LINK FOR ACCELERATING FOLDING OPERATION

[76] Inventor: Chi-Kuo Yang, P.O. Box 10160, Taipei, Taiwan

[21] Appl. No.: 198,300

[22] Filed: May 25, 1988

[51] Int. Cl.[4] ..... A45B 19/00

[52] U.S. Cl. ..... 135/25 R

[58] Field of Search ..... 135/25, 20, 26

[56] References Cited

U.S. PATENT DOCUMENTS

| | | | |
|---|---|---|---|
| 4,007,752 | 2/1977 | Weber | 135/25 R |
| 4,030,514 | 6/1977 | Schultes | 135/25 R |
| 4,077,420 | 3/1978 | Schultes et al. | 135/25 R |
| 4,420,007 | 12/1983 | Wu | 135/25 R |
| 4,676,262 | 6/1987 | Yang | 135/25 R |
| 4,739,783 | 4/1988 | Yang | 135/25 R |
| 4,766,917 | 8/1988 | Yang | 135/25 R |

*Primary Examiner*—J. Karl Bell

[57] ABSTRACT

An umbrella includes a plurality of links pivotally connected with one another to form a multiple-fold umbrella in which a resilient link is resiliently held among three links adjacent to a central handle of the umbrella for accelerating a folding operation of the umbrella links.

5 Claims, 2 Drawing Sheets

UMBRELLA INK MEANS HAVING RESILIENT LINK FOR ACCELERATING FOLDING OPERATION

BACKGROUND OF THE INVENTION

Heinz Weber dislosed a telescopic umbrella in his U.S. Pat. No. 4,007,752 having an umbrella stick, with a runner slidable thereon from which runner stretchers are pivoted, at the ends of which are seated dome ribs, and above each of which is located an auxiliary link running approximately parallel therewith, one end of each auxiliary link being hinged to a dome rib while the other end is hinged to a strut, said strut running, when the umbrella is in an open configuration, obliquely upwards from said slide strut towards the umbrella stick, and a control strut running from each stretcher approximately parallel with an inner dome rib part, the outer end of said control link and serving to control the folding motion of the outer dome rib part in dependence on the movement of the umbrella runner.

However, such a conventional umbrella has some technical limitations, impairing its folding motion, as shown as follows.

1. In the intermediate opening or closing phase of the umbrella, a controllable hinged parallelogram II is available between the dome rib part 86 and the control link 22. In order for increasing the effective leverage length of arm 25 for assisting the intermediate opening or closing operation, the slot 27 should be made as long as possible, thereby causing an unstable linking configuration when opening the umbrella or causing a larger volume when folding the umbrella links and ribs. If the slot 27 is made too short, the opening or closing operation of the umbrella will bear against a stronger pressure since the leverage length of arm 25 is quite limited within a shorter slot 27.

2. The folding operation of the umbrella is actuated by two parallelograms I, II, without being assisted by any resilient link or sliding mechanism, thereby causing a slow folding motion when closing the two paralellograms I, II constructed by the plural links and ribs.

The present inventor has found such drawbacks of a conventional shortenable umbrella and invented the present umbrella link means having accelerated folding operation.

SUMMARY OF THE INVENTION

The object of the present invention is to provide an umbrella link means for multiple-fold umbrella including a resilient link resiliently secured among three links of the umbrella links for accelerating a folding operation of the umbrella links.

Another objects of the present invention is to provide an umbrella link means including a sliding jacket slidably engaged on an intermediate umbrella link having a pair of reinforcing links respectively connecting an inner link and an outer link disposed on two opposite ends of the intermediate link, available for accelerating a folding operation of the umbrella links.

DETAILED DESCRIPTION

Figure 1:
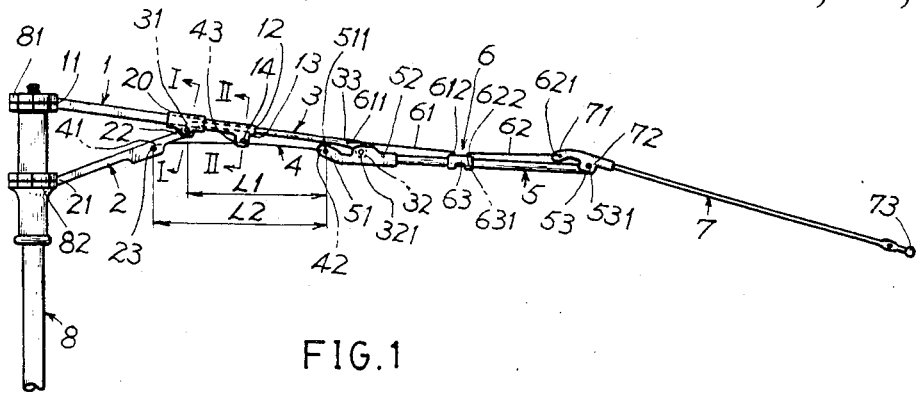
FIG. 1 is an illustration showing an extension of all umbrella links of the present invention.

As shown in the figures, the present invention comprises: a first link 1 generally having a U-shaped cross section and having an inner end 11 pivotally secured to an upper bracket 81 fixed on a top portion of a central handle 8 of the umbrella and having an outer opening end 12 opposite to the inner end 11; a second link 2 generally having a U-shaped cross section and having an inner end 21 pivotally secured to a lower bracket 82 movably jacketed on the central handle 8 and having an outermost end 22 pivotally secured, by a pin 201, to an inner sliding jacket 20 slidably jacketed on the first link 1; a third link 3 generally formed as a solid rod slidably engageable in the first link 1 through the outer opening end 12 of first link 1 having an inner end 31 protruding downwardly to be pivotally connected with the outermost end 22 of the second link 2 and also pivotally connected with the inner sliding jacket 20, and having an outermost end 32 pivotally connected to a fifth link 5 by a pin 321; a fourth link 4 being a spring rod having an inner end 41 pivotally secured to an outer portion 23 by a pin proximate to an outermost end 22 of the second link 2, having an outer end 42 pivotally secured to an innermost end 51 of the fifth link 5, and having a central loop portion 43 wound on a pivot 14 secured between two lugs 13 protruding from an outer end 12 of the first link 1; the fifth link 5 generally having a U-shaped cross section and having an inner portion 52 proximate to the innermost end 51 pivotally secured to the outer end 32 of the third link 3 and having an outer end 53 pivotally secured with an inner portion 72 of a seventh link 7 by a pin 531; a sixth link means 6 which includes an inner reinforcing link 61 having a inner end 611 pivotally secured to an outer portions 33 of the third link 3 proximate to the outermost end 32 of the third link 3 and having an outer end 612 formed as a hook portion engaged in a link hole 631 formed in an outer sliding jacket 63 slidably engageable on a central portion of the fifth link 5, and an outer reinforcing link 62 having an outer end 621 pivotally secured with an innermost end 71 of the seventh link 7 and having an inner end 622 formed as a hook portion engaged in the other link hole 631 formed in the sliding jacket 63; and the seventh link 7 having an outer end 73 secured with an outer periphery of an umbrella hood or cloth (not shown).

Figure 4:
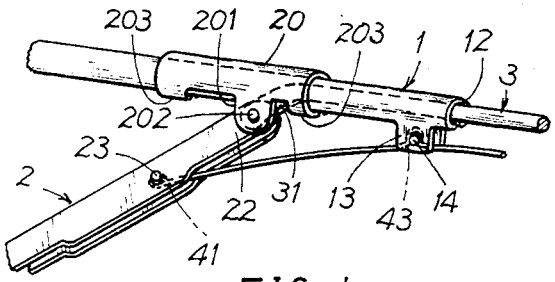
FIG. 4 is an enlarged view of several links in construction of the present invention.
Figure 5:
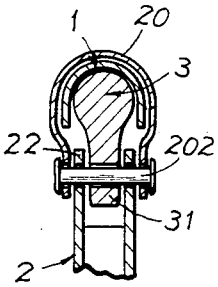
FIG. 5 is a sectional drawing of the present invention as viewed from I—I direction of FIG. 1.
Figure 6:
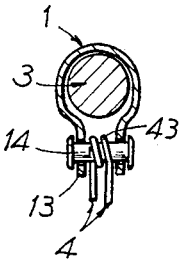
FIG. 6 is a sectional drawing of the present invention as viewed from II—II direction of FIG. 1.
Figure 7:
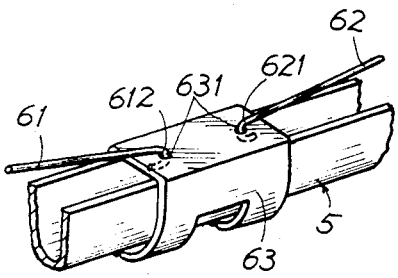
FIG. 7 is a perspective view of an outer sliding jacket of the present invention.

The inner sliding jacket 20 includes; a pair of lugs 201 protruding downwardly from the jacket, having a pin 202 transversely mounted between the two lugs 201 for pivotally connecting the outermost end 22 of the second link 2 and the inner end 31 of the third link 3, and a pair of crimped edges 203 movably encasing the first link 1 and the third link 3 therein as shown in FIG. 4.

The lower bracket 82 serves for raising the second link 2 for opening an umbrella or for lowering the link 2 for closing the umbrella. A central portion of an umbrella hood (not shown) is secured above the upper bracket 81.

As shown in FIG. 1, the fourth link 4 is resiliently linearly held among the second link 2, the first link 1 and the fifth link 5 to be generally linear and positioned below the first link 1 and the third link 3 to form a generally linear configuration. Whereas, the sixth link means 6 is generally positioned above the fifth link 5, opposite to the fourth link 4.

A distance L1 between the pin 201 of the outermost end 22 of the second link 2 and the pin 511 of the outer end 42 of the fourth link 4 should be smaller than a distance L2 between the outer portion 23 of the second pin 2 next to an outermost end 22 of the second pin 2 and the outer end 42 of the fourth link 4 as shown in FIG. 1 when extending (opening) the umbrella links to slide the inner jacket 20 outwardly.

Figure 3:
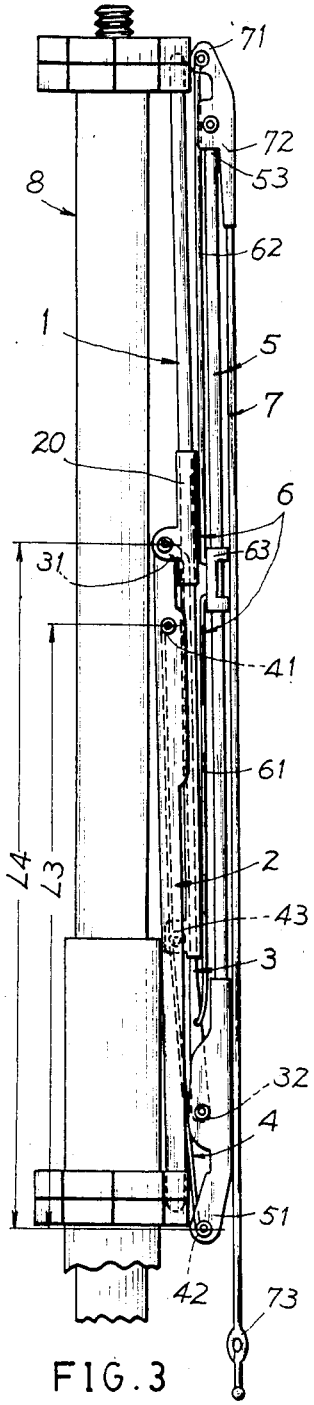
FIG. 3 shows a folded umbrella in accordance with the present invention.

A distance L3 between the outer portion 23 of the second link 2 and the outer end 42 of the fourth link 4 should be smaller than a distance L4 between the outermost end 22 of the second link 2 and the outer end 42 of the fourth link 4 as shown in FIG. 3 when folding (closing) the umbrella links to slide the inner jacket 20 inwardly.

Figure 2:
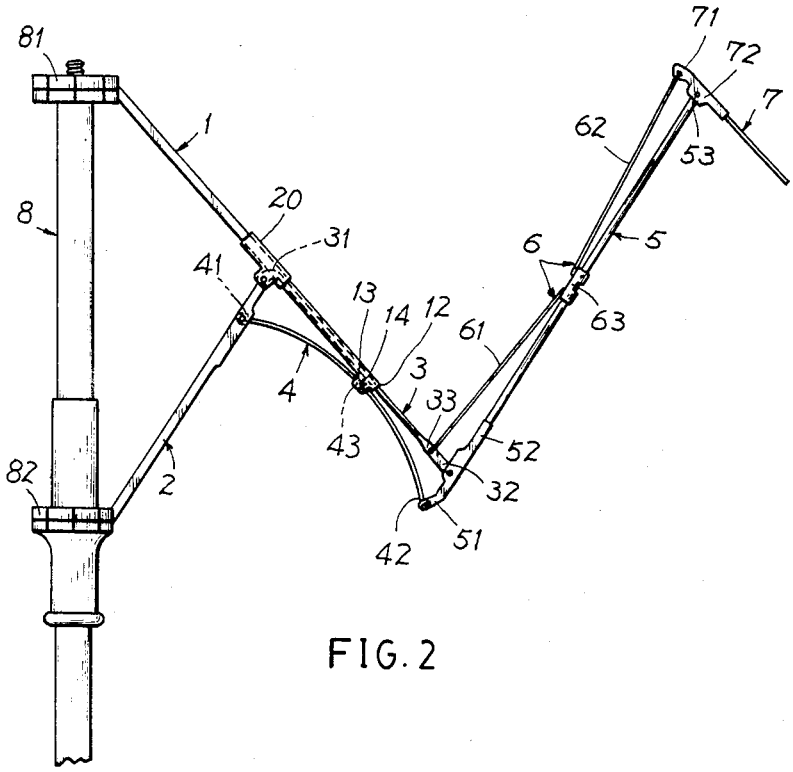
FIG. 2 is an illustration showing a folding link means of the present invention.

When folding the links of the present invention from FIG. 1 through FIG. 3, the fourth link 4 serving as a resilient link is arcuately bent (FIG. 2) to accumulate a resilience potential energy which will accelerate the folding of the links towards the central handle 8 as shown in FIG. 3. This phenomena is very helpful in folding a wet umbrella when an umbrella carrier who hurrys to get on a crowded city bus. After the umbrella is folded as shown in FIG. 3, the spring link 4 will also be straightened from its intermediate bending situation as shown in FIG. 2.

Meanwhile, the outer sliding jacket 63 as engaged by the two reinforcing links 61, 62 is slidably moving on the fifth link 5, which is very helpful for facilitating a closing or opening operation of the umbrella links. Once folded, the flat jacket 63 will not increase a volume of the folded links for convenient and esthetic purpose.

I. claim

1. A link means of a multiple-fold umbrella comprising:

a first link generally a U-shaped cross section and having its inner end pivotally secured to an upper bracket fixed on a top portion of a central handle of an umbrella and having an outer opening end formed on said first link opposite said inner end;

a second link generally having a U-shaped cross section and having its inner end pivotally secured to a lower bracket movably jacketed on the central handle of the umbrella and having its outermost end pivotally secured to an inner sliding jacket slidably jacketed on said first link;

a third link generally formed as a solid rod slidably engageable in said first link through said outer opening end of said first link having an inner end of said third link pivotally connected with said outermost end of said second link and said inner sliding jacket;

a fourth link being a spring rod pivotally secured between an outer portion of said second link proximate to said inner sliding jacket, and an innermost end of a fifth link, said fourth link having a central loop portion pivotally secured to said first link at said outer opening end of said first link, said fourth link resiliently linearly retaining said second link, said first link and said fifth link to extend a generally linear configuration of the link means when opening the umbrella; said fifth link generally having a U-shaped cross section and having an inner portion, proximate to its innermost end, pivotally secured to an outermost end of said third link;

a sixth link means pivotally connected between said third link and a seventh link; and said seventh link having its inner portion pivotally secured to an outer end of said fifth link, whereby upon a folding of said link means, said fourth link will resiliently accelerate folding of said link means towards said central handle for quicker closing of the umbrella.

2. A link means according to claim 1, wherein a first distance operatively defined between said outermost end of said second link and said outer end of said fourth link is smaller than a second distance defined between said outer portion of said second pin pivotally connecting said fourth link and the outer end of said fourth link when extending the umbrella links to slide said inner sliding jacket outwardly; and a third distance between said outer portion of said second link pivotally connecting the inner end of said fourth link and said outer end of said fourth link is smaller than a fourth distance between said outermost end of said second link and said outer end of said fourth link when folding said link means to slide said inner sliding jacket inwardly.

3. A link means according to claim 1, wherein said inner sliding jacket slidably engageable on said first link having a pair of lugs protruding downwardly to pivotally connect said outermost end of said second link and said inner end of said third link in said two lugs, and a pair of crimped edges movably encasing said first link and third link therein.

4. A link means according to claim 1, wherein sixth link means includes: an inner reinforcing link having an inner end pivotally secured to an outer portion of said third link proximate to said outermost end of said third link, and having an outer end formed as a hook portion engaged in a link hole formed in an outer sliding jacket slidably engageable on a central portion of said fifth link; and an outer reinforcing link having an outer end pivotally connected to an outermost end of said seventh link and having an inner end formed as a hook portion engaged in the other link hole formed in said outer sliding jacket.

5. A link means according to claim 1, wherein said fourth link has its central loop portion pivotally wound on a pin mounted between two lugs protruding downwardly from said first link at said outer end of said first link.

* * * * *